US012110652B2

(12) United States Patent
Izumikawa

(10) Patent No.: US 12,110,652 B2
(45) **Date of Patent: *Oct. 8, 2024**

(54) VEHICLE SHOVEL

(71) Applicant: SUMITOMO(S.H.I.) CONSTRUCTION MACHINERY CO., LTD., Tokyo (JP)

(72) Inventor: Takeya Izumikawa, Chiba (JP)

(73) Assignee: SUMITOMO(S.H.I.) CONSTRUCTION MACHINERY CO., LTD., Tokyo (JP)

( * ) Notice: Subject to any disclaimer, the term of this patent is extended or adjusted under 35 U.S.C. 154(b) by 193 days.

This patent is subject to a terminal disclaimer.

(21) Appl. No.: 17/328,149

(22) Filed: May 24, 2021

(65) Prior Publication Data

US 2021/0277624 A1 Sep. 9, 2021

Related U.S. Application Data

(63) Continuation of application No. 15/715,609, filed on Sep. 26, 2017, now Pat. No. 11,015,319, which is a (Continued)

(51) Int. Cl.
*E02F 9/22* (2006.01)
*E02F 3/32* (2006.01)
(Continued)

(52) U.S. Cl.
CPC ..... *E02F 3/439* (2013.01); *E02F 3/32* (2013.01); *E02F 3/3677* (2013.01); *E02F 3/435* (2013.01);
(Continued)

(58) Field of Classification Search
CPC ... E02F 9/26; E02F 9/262; E02F 9/265; E02F 9/2041; E02F 9/22; E02F 3/3677;
(Continued)

(56) References Cited

U.S. PATENT DOCUMENTS 4,332,517 A 6/1982 Igarashi et al.
6,076,029 A 6/2000 Watanabe et al.
(Continued)

FOREIGN PATENT DOCUMENTS

CA 2635117 A1 * 10/2006 ..... E01C 19/15
CN 102535556 A * 7/2012 ..... E02F 3/435
(Continued)

OTHER PUBLICATIONS

J. Kim, H. W. Jang, J. -U. Shin, J. -W. Hong and H. Myung, "Development of a Mole-Like Drilling Robot System for Shallow Drilling," in IEEE Access, vol. 6, pp. 76454-76463, 2018, doi: 10.1109/ACCESS.2018.2884495. (Year: 2018).*
(Continued)

*Primary Examiner* — Cuong H Nguyen
(74) *Attorney, Agent, or Firm* — IPUSA, PLLC

(57) ABSTRACT

A shovel includes: an arm rotatably attached to a boom rotatably attached to a revolving body; a bucket rotatably attached to the arm; a tilt mechanism configured to support the bucket that can be tilted to the arm; a bucket tilt angle sensor configured to detect a tilt angle of the bucket; and a tilt angle controller configured to control adjusting the tilt angle. The tilt angle controller adjusts the tilt angle by automatic control of the tilt mechanism so that a bucket line of the bucket becomes parallel to a target excavation surface. The automatic control of the tilt mechanism is enabled after moving the shovel and/or during rotating the shovel.

19 Claims, 6 Drawing Sheets

Related U.S. Application Data continuation of application No. PCT/JP2016/059684, filed on Mar. 25, 2016.

(51) Int. Cl.
*E02F 3/36* (2006.01)
*E02F 3/43* (2006.01)
*E02F 9/20* (2006.01)
*E02F 9/26* (2006.01)

(52) U.S. Cl.
CPC ..... *E02F 9/2041* (2013.01); *E02F 9/22* (2013.01); *E02F 9/262* (2013.01); *E02F 9/265* (2013.01)

(58) Field of Classification Search
CPC ... E02F 3/32; E02F 3/435; E02F 3/439; E02F 3/43; E02F 3/433; H04N 23/58; G01C 21/3415; B60W 2420/42; G06V 20/56; G06T 7/70; G05D 1/0246
USPC ..... 701/50, 23; 382/103; 280/727
See application file for complete search history.

(56) References Cited

U.S. PATENT DOCUMENTS

| | | | | |
|---|---|---|---|---|
| 6,532,409 | B1 | 3/2003 | Fujishima et al. | |
| 7,967,547 | B2 | 6/2011 | Osanai | |
| 7,993,091 | B2 | 8/2011 | Osanai et al. | |
| 8,914,199 | B2 * | 12/2014 | Nomura | E02F 3/32 703/2 |
| 8,965,642 | B2 * | 2/2015 | Johnson | E02F 3/3677 701/50 |
| 9,020,709 | B2 | 4/2015 | Matsuyama | |
| 9,080,317 | B2 | 7/2015 | Matsuyama | |
| 9,617,709 | B2 * | 4/2017 | Shintani | E02F 3/43 |
| 9,650,755 | B2 * | 5/2017 | Nomura | G01S 19/48 |
| 9,938,694 | B2 | 4/2018 | Matsuyama et al. | |
| 10,138,618 | B2 | 11/2018 | Davis et al. | |
| 10,704,228 | B2 | 7/2020 | Tsuji | |
| 11,015,319 | B2 * | 5/2021 | Izumikawa | E02F 9/2041 |
| 2003/0001751 | A1 | 1/2003 | Ogura et al. | |
| 2005/0027420 | A1 * | 2/2005 | Fujishima | E02F 9/2045 701/50 |
| 2006/0291987 | A1 * | 12/2006 | Osanai | E02F 3/432 414/685 |
| 2009/0159302 | A1 | 6/2009 | Koch et al. | |
| 2010/0254793 | A1 | 10/2010 | Trifunovic | |
| 2012/0283920 | A1 | 11/2012 | Kim et al. | |
| 2013/0158789 | A1 * | 6/2013 | Seki | G01S 19/23 701/34.4 |
| 2014/0095036 | A1 | 4/2014 | Hoff et al. | |
| 2014/0129093 | A1 | 5/2014 | Shirao et al. | |
| 2014/0142817 | A1 | 5/2014 | Matsuyama | |
| 2014/0330490 | A1 | 11/2014 | Aoki et al. | |
| 2015/0039189 | A1 * | 2/2015 | Wu | E02F 9/2012 701/50 |
| 2015/0275471 | A1 * | 10/2015 | Matsumoto | E02F 3/432 701/50 |
| 2015/0308081 | A1 * | 10/2015 | Takaura | E02F 3/437 701/50 |
| 2015/0308082 | A1 | 10/2015 | Takaura et al. | |
| 2015/0345114 | A1 | 12/2015 | Nomura et al. | |
| 2016/0040391 | A1 | 2/2016 | Imaizumi et al. | |
| 2016/0040398 | A1 | 2/2016 | Kitajima et al. | |
| 2016/0138240 | A1 * | 5/2016 | Ikegami | E02F 9/26 60/420 |
| 2016/0251835 | A1 * | 9/2016 | Kitajima | E02F 3/3663 701/50 |
| 2016/0258135 | A1 * | 9/2016 | Shimano | E02F 9/2029 |
| 2016/0265187 | A1 * | 9/2016 | Baba | E02F 3/963 |
| 2016/0273196 | A1 * | 9/2016 | Funk | E02F 3/432 |
| 2016/0312434 | A1 * | 10/2016 | Shintani | E02F 3/3681 |
| 2018/0016768 | A1 * | 1/2018 | Izumikawa | E02F 9/2041 |
| 2021/0277624 | A1 * | 9/2021 | Izumikawa | E02F 9/262 |
| 2022/0403617 | A1 * | 12/2022 | Matsuyama | E02F 3/32 |

FOREIGN PATENT DOCUMENTS

| | | | | |
|---|---|---|---|---|
| CN | 107407065 | A * | 11/2017 | E02F 3/32 |
| CN | 114761643 | A * | 7/2022 | E02F 3/32 |
| DE | 112013000124 | | 12/2014 | |
| EP | 3276088 | A1 * | 1/2018 | E02F 3/32 |
| EP | 3276088 | B1 * | 5/2022 | E02F 3/32 |
| GB | 2149751 | | 6/1985 | |
| JP | S54-004402 | | 1/1979 | |
| JP | S63-236827 | | 10/1988 | |
| JP | 2002-030690 | | 1/2002 | |
| JP | 2013-217137 | | 10/2013 | |
| JP | 2014-074319 | | 4/2014 | |
| JP | 6591531 | B2 * | 10/2019 | E02F 3/32 |
| JP | 6915000 | B2 * | 8/2021 | E02F 3/32 |
| WO | 2012/127912 | | 9/2012 | |
| WO | 2014/051170 | | 4/2014 | |
| WO | 2014/093625 | | 6/2014 | |
| WO | 2014/192475 | | 12/2014 | |
| WO | 2016/158779 | | 10/2016 | |
| WO | WO-2016158779 | A1 * | 10/2016 | E02F 3/32 |

OTHER PUBLICATIONS

W. B. Klinger, I. R. Bertaska, K. D. von Ellenrieder and M. R. Dhanak, "Control of an Unmanned Surface Vehicle With Uncertain Displacement and Drag," in IEEE Journal of Oceanic Engineering, vol. 42, No. 2, pp. 458-476, Apr. 2017, doi: 10.1109/JOE.2016.2571158. (Year: 2017).*

J. Yao et al., "Bucket Loading Trajectory Optimization for the Automated Wheel Loader," in IEEE Transactions on Vehicular Technology, doi: 10.1109/TVT.2023.3236507. (Year: 2023).*

M. Hutter et al., "Force Control for Active Chassis Balancing," in IEEE/ASME Transactions on Mechatronics, vol. 22, No. 2, pp. 613-622, Apr. 2017, doi: 10.1109/TMECH.2016.2612722. (Year: 2017).*

Huang, Sichuan. Self-burrowing mechanism and robot inspired by razor clams. Diss. Arizona State University, 2020. (Year: 2020).*

International Search Report for PCT/JP2016/059684 mailed on Jun. 14, 2016.

Control of virtual excavating system base on real-time simulation; Quang Hoan Le;Young-man Jeong;Chi Thanh Nguyen;Soon-Yong Yang; 2012 12th International Conference on Control, Automation and Systems; IEEE Conference Paper. (Year: 2012).

Path tracking for a hydraulic excavator utilizing proportional-derivative and linear quadratic control; Seonhyeok kang; Jaemann Park;Seunghyun Kim;Bongju Lee;Youngbum Kim;Panyoung Kim;H. Jin Kim; 2014 IEEE Conference on Control Applications (CCA); IEEE Conference Paper. (Year: 2014).

Predicting Parameters by Neural Network Learning ang Nonlinear Controls of the Hydraulic Crawler Excavator Using Them Jong-Gyu Park;Quoc-Dong Hoang;Soon Geul Lee; 2020 20th International Conference on Control, Automation and Systems (ICCAS); IEEE Conference Paper. (Year: 2020).

Research on laser beam riding guided excavator; Jiang Haiyong;Qi Xiaona;Liu Jiangtao;Li xin; 2010 2nd International Asia Conference on Informatics in Control, Automation and Robotics (CAR 2010); IEEE Conference Paper vol. 1. (Year: 2010).

* cited by examiner

VEHICLE SHOVEL

CROSS-REFERENCE TO RELATED APPLICATIONS

The present application is a continuation application of U.S. patent application Ser. No. 15/715,609, which is a continuation application of International Application PCT/JP2016/059684 filed on Mar. 25, 2016, and designated the U.S., which is based on and claims priority based on Japanese Patent Application No. 2015-067684 filed on Mar. 27, 2015. The entire contents of each of the foregoing applications are incorporated herein by reference.

BACKGROUND

Technical Field

The present disclosure relates to a shovel having a bucket tilt mechanism.

Description of Related Art

Excavation control systems have been proposed that automatically adjust the cutting-edge position of a bucket of a shovel, and execute excavation restriction control so as to move the cutting edge of the bucket along a designed surface. Such a shovel has, as a bucket rotational axis, a single rotational axis that is parallel to a road surface or the like on which the shovel is installed. Therefore, the cutting edge of the bucket is always maintained parallel to the road surface.

When excavating a slope surface (a slope) with a bucket, it is preferable to move the bucket diagonally upward or diagonally downward along the slope surface, while maintaining the teeth end of the bucket parallel to the slope surface. In the above excavation control system, when the longitudinal direction of the boom and the arm coincides with the vertical direction of the slope surface, the teeth end of the bucket is parallel to the slope surface. However, if the bucket is moved along the slope surface while revolving the revolving upper body to which the boom is attached, the longitudinal direction of the boom and the arm inclines to the vertical direction of the slope surface, and consequently, a bucket line formed by working parts of the bucket (including, for example, a teeth end line connecting both ends of the cutting edge (an example of a working part), and a back surface line along the edge of the back surface of the bucket (an example of a working part)) inclines to the slope surface. In this case, the surface excavated by the bucket inclines to the slope surface, and hence, it is not possible to make the excavated surface precisely fit the target surface.

SUMMARY

According to an embodiment in the present disclosure, a shovel includes an arm rotatably attached to a boom rotatably attached to a revolving body; a bucket rotatably attached to the arm; a tilt mechanism configured to support the bucket that can be tilted to the arm; a bucket tilt angle sensor configured to detect a tilt angle of the bucket; and a tilt angle controller configured to control adjusting the tilt angle, wherein the tilt angle controller adjusts the tilt angle by automatic control so that a bucket line of the bucket becomes parallel to a target excavation surface.

DETAILED DESCRIPTION

In the following, embodiments will be described with reference to the drawings.

According to a disclosed embodiment, the tilt angle of the bucket is automatically corrected while operating the shovel so that the bucket line is always parallel to the inclined target surface. This makes it possible, for example, if excavation work on a slope surface is performed while revolving the revolving upper body, to raise precision of the excavation surface because the bucket line is always maintained parallel to the slope surface automatically.

Figure 1:
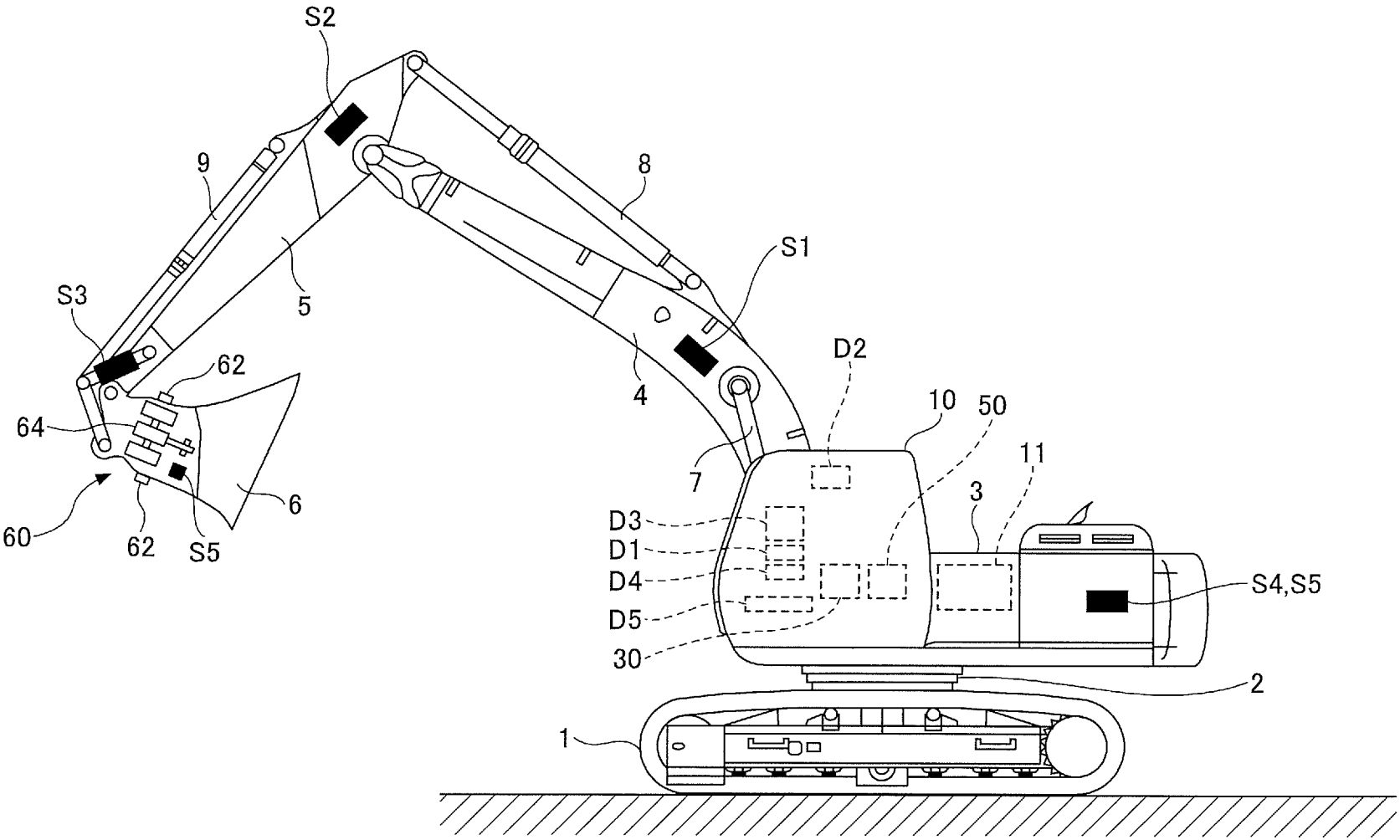
FIG. 1 is a side view of a shovel according to an embodiment.

FIG. 1 is a side view of a shovel according to an embodiment. A revolving upper body 3 is mounted on a traveling lower body 1 of the shovel via a revolution mechanism 2. A boom 4 is attached to the revolving upper body 3. An arm 5 is attached at the tip of the boom 4, and a bucket 6 as an end attachment is attached at the tip of the arm 5. As the end attachment, a bucket for slope surface, a bucket for dredging, or the like may be used.

As an example of an attachment, the boom 4, the arm 5, and the bucket 6 constitute an excavation attachment, which are oil-pressure driven by a boom cylinder 7, an arm cylinder 8, and a bucket cylinder 9, respectively. A boom angle sensor S1 is attached to the boom 4, an arm angle sensor S2 is attached to the arm 5, and a bucket angle sensor S3 is attached to the bucket 6. The boom angle sensor S1, the arm angle sensor S2, and the bucket angle sensor S3 may be referred to as "orientation sensors".

The bucket 6 is what-is-called a tilt bucket; the bucket 6 is rotatable in a direction perpendicular to the page surface with respect to the arm 5. Specifically, a tilt mechanism 60 is provided at a portion at which the bucket 6 is attached to the arm 5. The tilt mechanism 60 has a pin 62 (tilt axis) that rotatably supports the bucket 6, and a tilt bucket cylinder 64 for rotating the bucket 6. By driving the tilt bucket cylinder 64, it is possible to rotate the bucket 6 around the pin 62. Note that a bucket tilt angle sensor S5 is attached to the bucket 6. The bucket tilt angle sensor S5 is a sensor that detects an angle of rotation of the bucket 6 around the tilt axis, and outputs the detected value.

The boom angle sensor S1 detects a rotation angle of the boom 4. In the embodiment, the boom angle sensor S1 is an acceleration sensor that detects inclination to the level surface, and detects a rotation angle of the boom 4 with respect to the revolving upper body 3. The arm angle sensor S2 detects a rotation angle of the arm 5. In the embodiment, the arm angle sensor S2 is an acceleration sensor that detects inclination to the level surface, and detects a rotation angle of the arm 5 with respect to the boom 4. The bucket angle sensor S3 detects a rotation angle of the bucket 6. In the embodiment, the bucket angle sensor S3 is an acceleration sensor that detects inclination to the level surface, and detects a rotation angle of the bucket 6 with respect to the arm 5. The boom angle sensor S1, the arm angle sensor S2, and the bucket angle sensor S3 may be a potentiometer using a variable resistor, a stroke sensor that detects the amount of strokes of the corresponding oil pressure cylinder, a rotary encoder that detects the rotation angle around a linking pin, or the like.

The revolving upper body 3 has a cabin 10, and has a power source such as an engine 11 installed. Also, a body inclination sensor S4 is attached to the revolving upper body 3. The body inclination sensor S4 is a sensor that detects inclination of the revolving upper body 3 to the level surface. In the embodiment, the body inclination sensor S4 is a biaxial acceleration sensor that detects inclination angles in a back-and-forth direction and a right-and-left direction of the revolving upper body 3. The body inclination sensor S4 may be referred to as an "orientation sensor".

In the cabin 10, an input unit D1, a sound output unit D2, a display unit D3, a memory unit D4, a gate lock lever D5, a controller 30, and a machine guidance device 50 are installed.

The controller 30 functions as a main controller that executes drive control of the shovel. In the embodiment, the controller 30 is constituted with an arithmetic processing unit including a CPU and an internal memory. Various functions of the controller 30 are implemented by the CPU that runs a program stored in the internal memory.

The machine guidance device 50 guides operations of the shovel. In the embodiment, the machine guidance device 50 visually and auditorily informs the operator, for example, about a distance in the perpendicular direction between the surface of a target geographical feature set by the operator and the tip (teeth end) position of the bucket. As such, the machine guidance device 50 guides operations of the shovel performed by the operator. Note that the machine guidance device 50 may only visually inform the operator, or may only auditorily inform the operator, about the distance. Specifically, similar to the controller 30, the machine guidance device 50 is constituted with an arithmetic processing unit including a CPU and an internal memory. Various functions of the machine guidance device 50 are implemented by the CPU that runs a program stored in the internal memory. The machine guidance device 50 may be provided as a device separate from the controller 30, or may be built in the controller 30.

The input unit D1 is a device for an operator of the shovel to input various information items into the machine guidance device 50. In the embodiment, the input unit D1 is a membrane switch attached to the surface of the display unit D3. A touch panel or the like may be used as the input unit D1. The operator can input a target excavation surface by using the input unit D1. Also, the operator may input the height from the target excavation surface so as to set a tilt control start surface used as a reference to start automatic bucket tilt control, which will be described later. Accordingly, the target excavation surface and the tilt control start surface are stored in the memory unit D4 of the machine guidance device 50. Also, at least one of the target excavation surface and the tilt control start surface may be stored in the memory unit D4 via communication.

The sound output unit D2 outputs various audio information items in response to a sound output command from the machine guidance device 50. In the embodiment, an in-vehicle speaker directly connected to the machine guidance device 50 is used as the sound output unit D2. Note that an alarm such as a buzzer may be used as the sound output unit D2.

The display D3 displays various image information items in response to a command from the machine guidance device 50. In the embodiment, an in-vehicle liquid crystal display directly connected to the machine guidance device 50 is used as the display unit D3.

The memory unit D4 is a device for storing various information items. In the embodiment, a non-volatile storage medium, such as a semiconductor memory, is used as the memory unit D4. The memory unit D4 stores various information items output by the machine guidance device 50 and the like.

The gate lock lever D5 is a mechanism to prevent the shovel from being operated erroneously. In the embodiment, the gate lock lever D5 is placed between the door of the cabin 10 and the driver's seat. If the gate lock lever D5 is pulled up so that the operator cannot leave the cabin 10, various operation units become operational. On the other hand, if the gate lock lever D5 is pressed down so that the operator can leave the cabin 10, various operation units become not operational.

Figure 2:
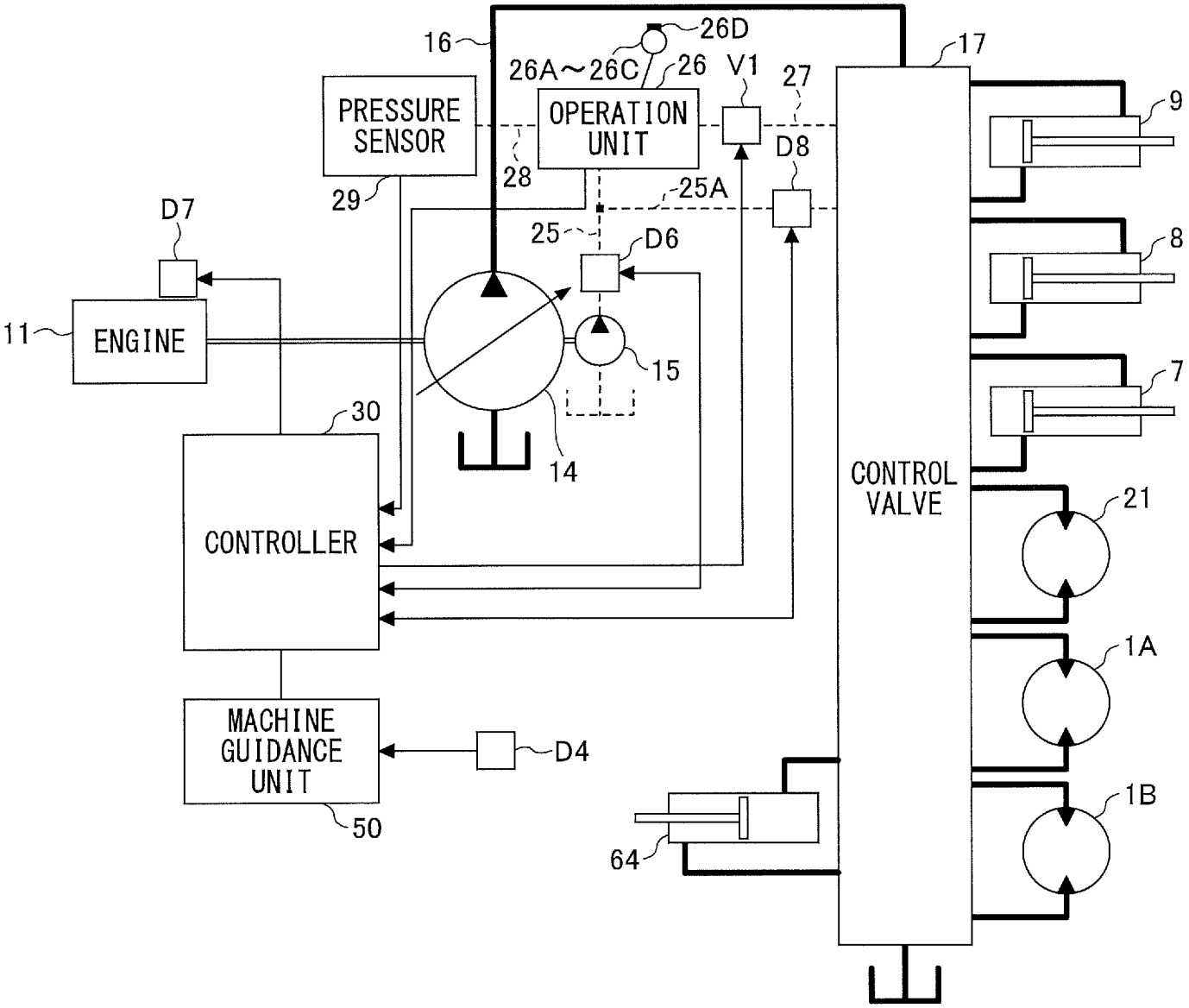
FIG. 2 is a block diagram illustrating a configuration of a drive system of the shovel illustrated in FIG. 1.

FIG. 2 is a block diagram illustrating a configuration of a drive system of the shovel in FIG. 1. In FIG. 2, a mechanical drive system is represented by double lines, high-pressure oil pressure lines are represented by bold solid lines, pilot lines are represented by dashed lines, and an electrical drive-and-control system is represented by thin solid lines, respectively.

The engine 11 is the power source of the shovel. In the embodiment, the engine 11 is a diesel engine that adopts isochronous control to maintain a constant number of revolutions of the engine irrespective of increase or decrease of the engine load. The amount of fuel injection, fuel injection timing, boost pressure, and the like in the engine 11 are controlled by the engine controller D7.

The engine controller D7 is a device that controls the engine 11. In the embodiment, the engine controller D7 executes various functions including an automatic idling function and an automatic idling stop function.

The automatic idling function is a function to reduce the number of revolutions of the engine from a normal number of revolutions (for example, 2,000 rpm) to a number of revolutions for idling (for example, 800 rpm) if a predetermined condition is satisfied. In the embodiment, the engine controller D7 activates the automatic idling function in response to an automatic idling command from the controller 30, to reduce the number of revolutions of the engine to the number of revolutions for idling.

The automatic idling stop function is a function to stop the engine 11 if a predetermined condition is satisfied. In the embodiment, the engine controller D7 activates the automatic idling stop function in response to an automatic idling stop command from the controller 30, to stop the engine 11.

A main pump 14 and a pilot pump 15 as oil hydraulic pumps are connected to the engine 11. A control valve 17 is connected to the main pump 14 via a high-pressure oil pressure line 16.

The control valve 17 is an oil pressure control device that controls the oil pressure system of the shovel. Oil hydraulic actuators including an oil pressure motor 1A for right side traveling, an oil pressure motor 1B for left side traveling, the boom cylinder 7, the arm cylinder 8, the bucket cylinder 9, an oil pressure motor 21 for revolution, and the tilt bucket cylinder 64 are connected to the control valve 17 via the high-pressure oil pressure lines.

An operation unit 26 is connected to the pilot pump 15 via a pilot line 25 and a gate lock valve D6. Also, the control valve 17 is connected to the pilot pump 15 via a pilot line 25A and a switching valve D8. The operation unit 26 includes a lever 26A, a lever 26B, a pedal 26C, and an automatic tilt switch 26D. In the embodiment, the operation unit 26 is connected to the control valve 17 via an oil pressure line 27. A pressure-reducing valve V1 controlled by the controller 30 is provided on the oil pressure line 27. Also, the operation unit 26 is connected to a pressure sensor 29 via an oil pressure line 28.

The gate lock valve D6 switches communicating and cutoff states of the pilot line 25 that connects the pilot pump 15 and the operation unit 26 to each other. In the embodiment, the gate lock valve D6 is an electromagnetic valve that switches the communicating and cutoff states of the pilot line 25 in response to a command from the controller 30. The controller 30 determines the state of the gate lock lever D5 based on a state signal output by the gate lock lever D5. Then, if having determined that the gate lock lever D5 is in a state of being pulled up, the controller 30 outputs a communication command to the gate lock valve D6. In response to receiving the communication command, the gate lock valve D6 is opened to enable communication through the pilot line 25. As a result, an operation of the operator on the operation unit 26 becomes effective. On the other hand, if having determined that the gate lock lever D5 is in a state of being pressed down, the controller 30 outputs a cutoff command to the gate lock valve D6. In response to receiving the cutoff command, the gate lock valve D6 is closed to cut off the pilot line 25. As a result, an operation of the operator on the operation unit 26 becomes ineffective.

The switching valve D8 switches communicating and cutoff states of the pilot line 25A that connects the pilot pump 15 and the control valve 17 to each other. In the embodiment, the switching valve D8 is an electromagnetic proportional valve that switches the communicating and cutoff states of the pilot line 25A in response to a command from the controller 30. The controller 30 outputs a communication command to the switching valve D8 when starting automatic bucket tilt control, which will be described later. In response to receiving the communication command, the switching valve D8 is opened to enable communication through the pilot line 25A, to execute the automatic bucket tilt control.

The pressure sensor 29 detects pressure corresponding to an operation on the operation unit 26. The pressure sensor 29 outputs the detected value to the controller 30.

Figure 3:
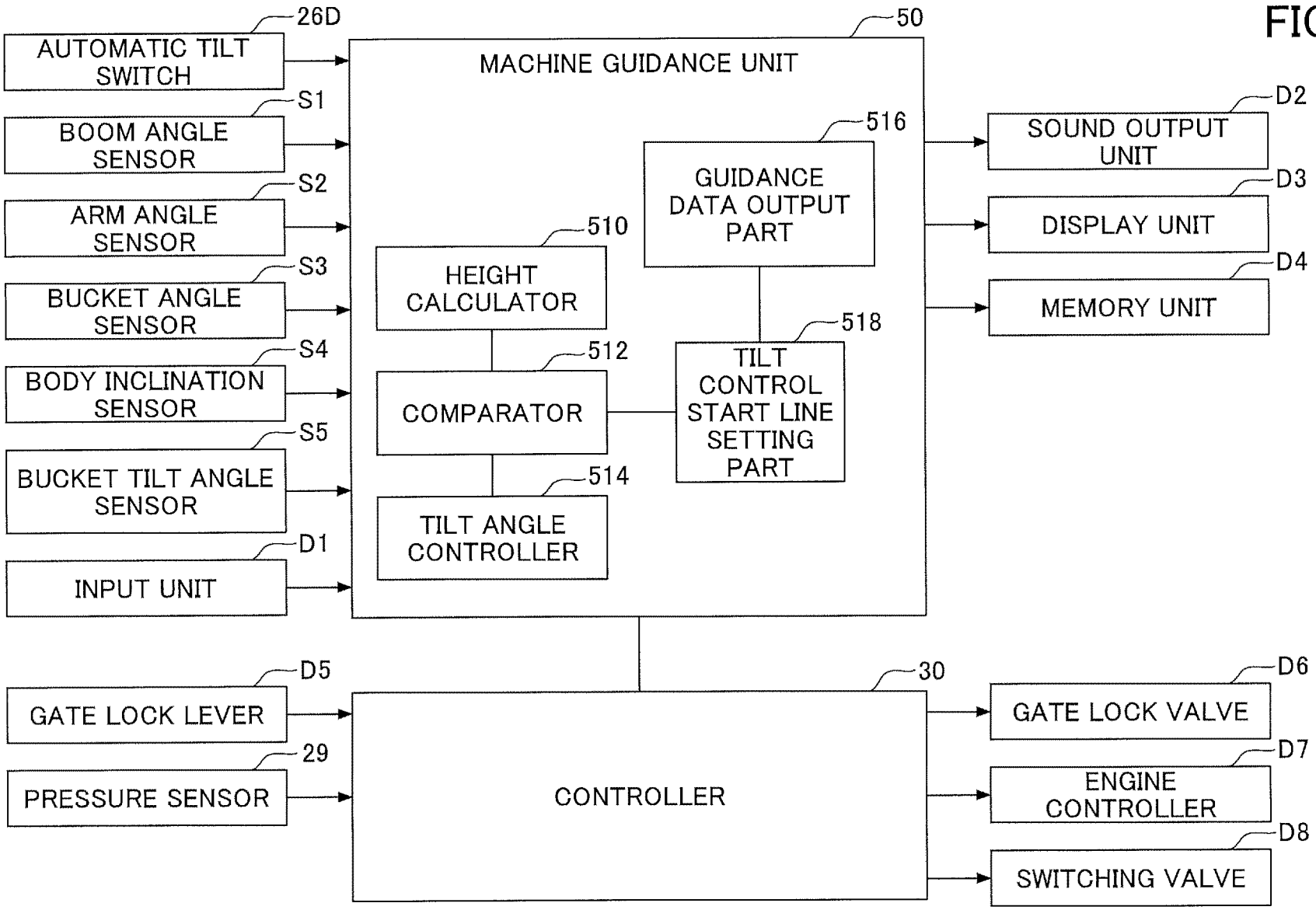
FIG. 3 is a block diagram illustrating a functional configuration of a controller and a machine guidance device.

Next, referring to FIG. 3, various functional elements provided in the controller 30 and the machine guidance device 50 will be described. FIG. 3 is a functional block diagram illustrating a configuration of the controller 30 and the machine guidance device 50.

In the embodiment, in addition to controlling operations of the entire shovel, the controller 30 controls whether to execute guidance by the machine guidance device 50. Specifically, the controller 30 determines whether the shovel is inactive based on the state of the gate lock lever D5, a detection signal from the pressure sensor 29, and the like. Then, if having determined that the shovel is inactive, the controller 30 sends a guidance stop command to the machine guidance device 50 so that guidance by the machine guidance device 50 is to be stopped.

Also, when outputting an automatic idling stop command to the engine controller D7, the controller 30 may output a guidance stop command to the machine guidance device 50. Alternatively, if having determined that the gate lock lever D5 is in a pressed-down state, the controller 30 may output a guidance stop command to the machine guidance device 50.

Next, the machine guidance device 50 will be described. In the embodiment, the machine guidance device 50 receives various signals and data output from the boom angle sensor S1, the arm angle sensor S2, the bucket angle sensor S3, the body inclination sensor S4, the bucket tilt angle sensor S5, the input unit D1, and the controller 30. The machine guidance device 50 calculates an actual working position of an attachment (for example, the bucket 6), based on a received signal and data. Then, if the actual working position of the attachment is different from a target working position, the machine guidance device 50 transmits an alarm command to the sound output unit D2 and the display unit D3, to issue an alarm. The machine guidance device 50 and the controller 30 are connected to a CAN (Controller Area Network) so as to be capable of communicating with each other.

The machine guidance device 50 includes functional units that execute various functions. In the embodiment, the machine guidance device 50 includes a height calculator 510, a comparator 512, a tilt angle controller 514, a guidance data output unit 516, and a tilt control start line setting part 518, as functional units for controlling operations of the attachment.

The height calculator 510 calculates a height at the tip (teeth end) of the bucket 6 from an inclination angle of the revolving upper body 3 calculated from angles of the boom 4, the arm 5, and the bucket 6 calculated from detection signals of the sensors S1-S3 and a detection signal of the sensor S4.

The guidance data output unit 516 reads guidance data including data related to a target excavation surface stored in advance in the memory unit of the machine guidance device 50 as described above, and outputs the data to the tilt control start line setting part 518. This configuration makes it possible for the operator to set a target excavation surface in advance by using the input unit D1.

The tilt control start line setting part 518 sets a tilt control start line at a position having a predetermined distance from the target excavation line in the guidance data, and outputs the guidance data to the comparator 512.

The comparator 512 compares the height at a tip (teeth end) of the bucket 6 calculated by the height calculator 510, with the tilt control start line represented in the guidance data output from the tilt control start line setting part 518.

Based on a comparison result obtained by the comparator 512, the tilt angle controller 514 determines whether a working part (for example, the teeth end) of the bucket 6 is at a position closer the target excavation line than the tilt control start line (is positioned between the tilt control start line and the target excavation line). If the working part of the bucket 6 is determined to be at a position closer the target excavation line than the tilt control start line, the tilt angle controller 514 controls the tilt angle of the bucket 6, to adjust the bucket line (for example, the teeth end line) of the bucket 6 to become parallel to the target excavation surface. Note that the bucket line is a line formed by the working part of the bucket 6, which includes, for example, the teeth end line connecting both ends of the cutting edge (an example of the working part), a back surface line along the edge of the back surface of the bucket (an example of the working part), and the like. In other words, the bucket line is defined as a line segment that connects at least two points of the working part contacting the target excavation surface. Specifically, the tilt angle controller 514 calculates a current angle deviation of the tilt angle of the bucket 6 with respect to the target excavation surface by using detection signals of the sensor S1-S4, and transmits a control signal to the controller 30 to reduce the calculated angle deviation. Based on this, the controller 30 executes automatic control so that the teeth end line of the bucket 6 is parallel to the target excavation surface. Also, for the calculation of the angle of the teeth end line of the bucket 6, a GNSS device or the like may be used in addition to the sensors S1-S4.

Here, the example has been described in which the working part of the attachment is the tip (teeth end) of the bucket 6; however, any position of the bucket 6 may be used as the working part. For example, in work done by using the back surface of the bucket 6, the back surface of the bucket 6 may be the working part.

Figure 4:
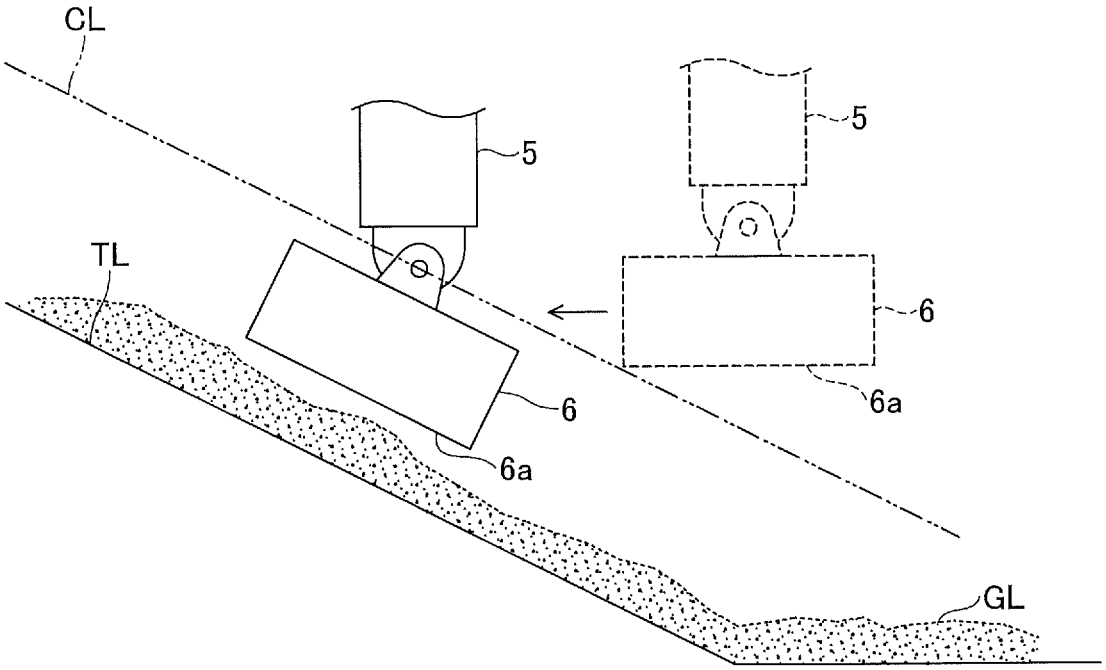
FIG. 4 is a diagram for describing automatic bucket tilt control.

Next, referring to FIG. 4, the automatic bucket tilt control by the machine guidance device 50 will be described. FIG. 4 is a diagram for describing an example of the automatic bucket tilt control according to the embodiment.

FIG. 4 illustrates control that makes the teeth end line of the bucket 6 parallel to the slope surface (slope). In FIG. 4, a tilt control start line CL that represents a tilt control start surface used as a reference to start the automatic bucket tilt control, is positioned to have a predetermined distance from a target line TL that represents a target excavation surface. Note that the target line TL is a line on the target excavation surface corresponding to the teeth end line of the bucket 6. The tilt control start line CL is set in the guidance data by the tilt control start line setting part 518 in FIG. 3 as described above.

In the automatic bucket tilt control according to the embodiment, when the bucket 6 is far from the target excavation surface (corresponding to the target line TL in FIG. 4), the automatic control of the tilt angle of the bucket 6 is not executed, but as designated by a dotted line in FIG. 4, the teeth end line 6*a* of the bucket 6 is maintained to be horizontal. If the bucket 6 approaches the target excavation surface, and the teeth end of the bucket 6 reaches the tilt control start surface (corresponding to the tilt control start line CL in FIG. 4), the automatic control of the tilt angle of the bucket 6 starts. Once the automatic control of the tilt angle has started, the tilt angle is adjusted so that the teeth end line 6*a* of the bucket 6 is maintained to be parallel to the target line TL. Determining whether the teeth end of the bucket 6 comes in contact with the tilt control start surface (corresponding to the tilt control start line CL in FIG. 4), is executed by the comparator 512 described above.

While the bucket 6 is positioned between the tilt control start surface (corresponding to the tilt control start line CL in FIG. 4) and the target excavation surface (corresponding to the target line TL in FIG. 4), the automatic bucket tilt control is continuously executed to make the teeth end line 6*a* of the bucket 6 parallel to the target excavation surface, by the signal from the controller 30. The automatic bucket tilt control is automatically executed by the machine guidance device 50, in which the operator of the shovel does not manually adjust the tilt angle of the bucket 6. Therefore, the operator of the shovel can precisely fit the teeth end line 6*a* of the bucket 6 with the target excavation surface even if the operator does not adjust the angle to the target surface of the teeth end line 6*a* of the bucket 6 during the excavation work.

However, if the work is done on the slope surface, and the operator operates the lever for revolution, the teeth end line 6*a* of the bucket 6 becomes not parallel to the target excavation surface. The same happens if the shovel faces a direction obliquely crossing the slope surface, and the boom or the like is operated. Therefore, if the position of the bucket 6 is lower than the tilt control start line CL, the operation of an oil hydraulic actuator under operation is limited even if the operator performs a revolution operation or operates on the boom, the arm, the bucket, or the like, so that the angle between the teeth end line 6*a* of the bucket 6 and the target excavation surface is maintained to be less than or equal to a predetermined angle. Specifically, if the angle between the teeth end line 6*a* of the bucket 6 and the target excavation surface exceeds the predetermined angle, the pilot pressure is reduced by the pressure-reducing valve V1. Accordingly, it is possible to limit the operational speed of a revolution operation and an operation on the boom, the arm, the bucket, or the like.

After the excavation operation completed, and the teeth end of the bucket 6 has moved outside (upward in FIG. 4) of the tilt control start surface (the tilt control start line CL), the automatic bucket tilt control is released (disabled), and as designated by the dotted line in FIG. 4, the teeth end line 6*a* of the bucket 6 is leveled. This makes it possible, for example, if earth and sand are scooped up by the bucket 6, to prevent the earth and sand from falling out of the bucket 6. The tilt angle of the bucket 6 after the release is determined in advance depending on contents of work and the like. Also, to realize this control, the load imposed on the bucket 6, the arm 5, or the boom 4 may be monitored, for example, when the bucket 6 is stuck in the earth surface or the bucket 6 scoops up earth and sand, and when this load becomes lower than a predetermined value, the teeth end line 6*a* of the bucket 6 may be leveled. In this way, the automatic bucket tilt control may be released (disabled), depending on the detected load so as to make the teeth end line 6*a* of the bucket 6 leveled as designated by the dotted line in FIG. 4.

If an acceleration sensor is used as the bucket tilt angle sensor S5, it is possible to determine whether the teeth end line 6*a* of the bucket 6 is level only based on the detection signal of the bucket tilt angle sensor S5. If another angle sensor such as a rotary encoder is used as the bucket tilt angle sensor S5, it is possible to determine whether the teeth end line 6*a* is level, by obtaining the angle of the teeth end line 6*a* of the bucket 6, based on the output signals from the sensors S1-S4 described above.

Note that the automatic bucket tilt control according to the embodiment may be activated when the operator of the shovel wants to adjust the bucket tilt angle automatically. Therefore, as illustrated in FIG. 2, the automatic tilt switch 26D, which is used for turning on and off the automatic bucket tilt control, may be attached at the tips of the levers 26A-26B and the like, and the automatic tilt switch 26D may be turned on only when the operator of the shovel wants to execute the automatic bucket tilt control. In other words, only when there is a command from the operator, a communication command is output to the switching valve D8, to enable the automatic bucket tilt control. Note that the automatic tilt switch 26D may be attached to the pedal 26C.

Also, although the tilt control start line CL is set as the reference to start the automatic bucket tilt control to make the teeth end line 6*a* of the bucket 6 parallel to the target line TL, the control is not limited as such. For example, when the bucket 6 touches the earth surface (a ground line GL in FIG. 4), the teeth end line 6*a* of the bucket 6 may be made parallel to the target line TL.

Although the automatic bucket tilt control according to the embodiment has been described assuming that the machine guidance device 50 executes the control, the control is not necessarily executed by the machine guidance device 50. For example, if guidance data including a target line TL is available, the controller 30 or another control device may execute the control.

Figure 5A:
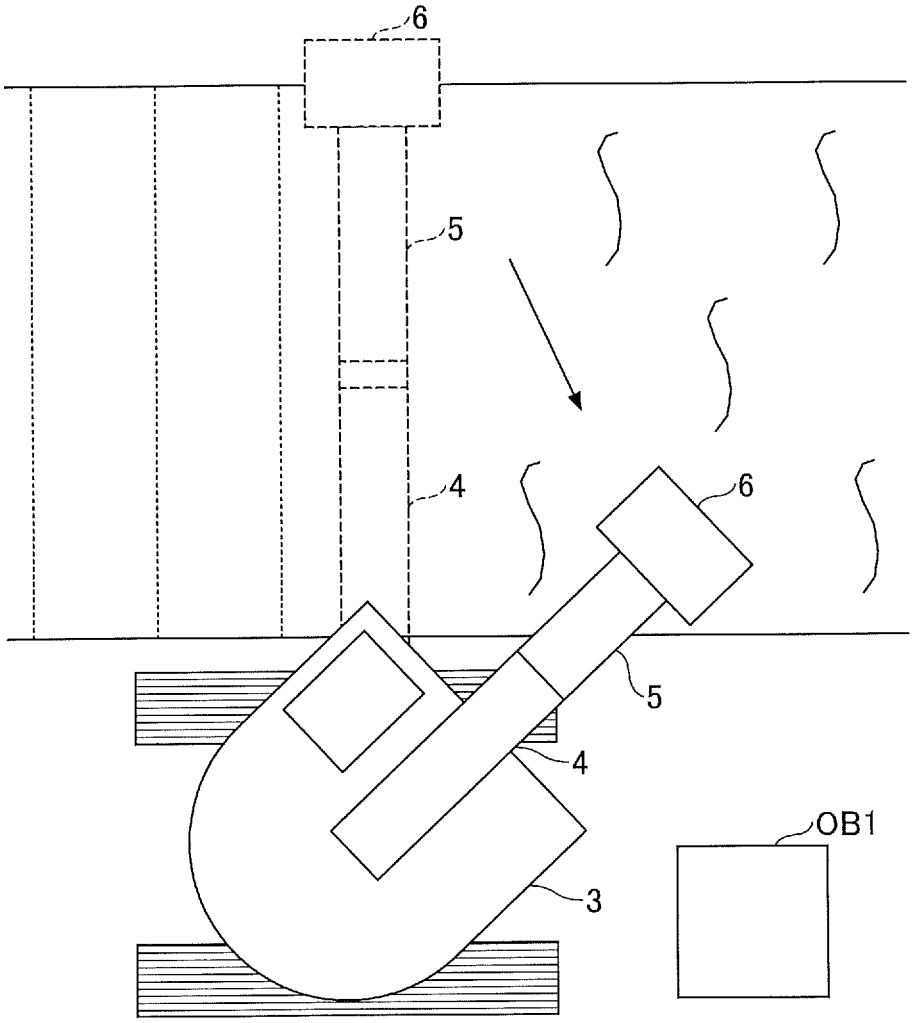
FIG. 5A is a diagram illustrating an example of excavation work by a bucket.
Figure 5B:
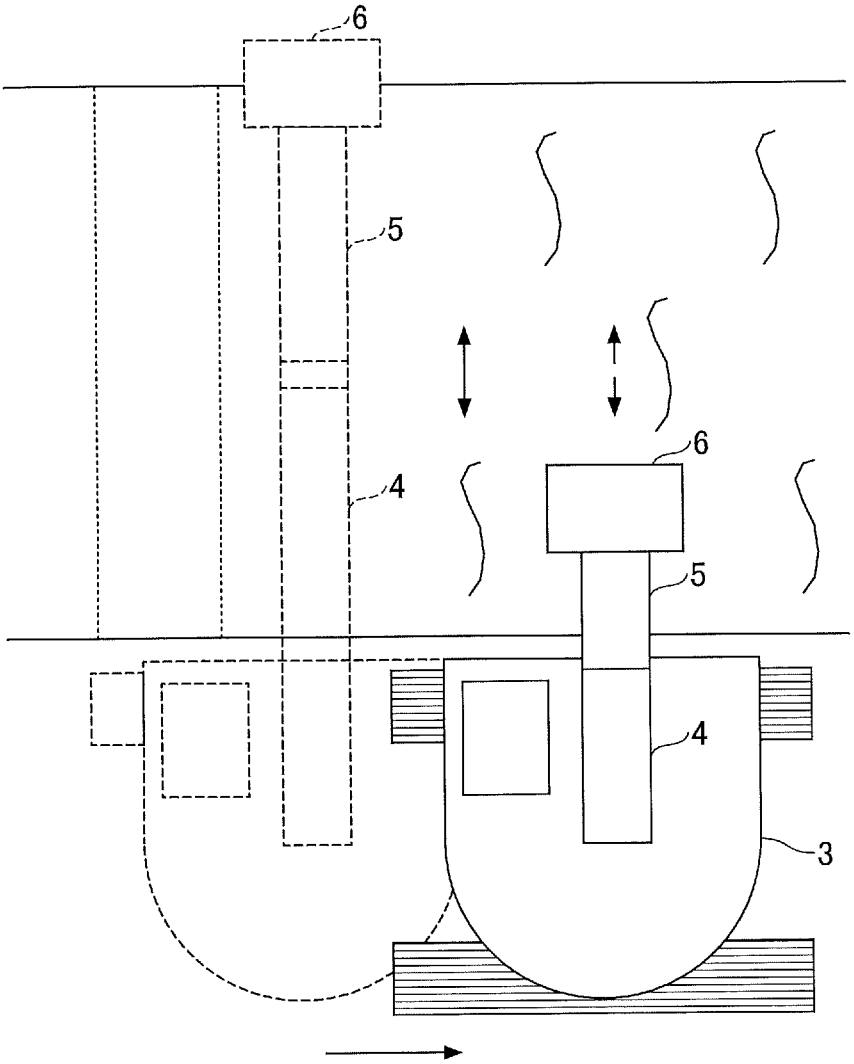
FIG. 5B is a diagram illustrating another example of excavation work by a bucket.

FIG. 5A and FIG. 5B are diagrams illustrating examples of excavation work by a bucket. FIG. 5A illustrates an example of excavation work in which it is preferable to enable the automatic bucket tilt control according to the above embodiment. FIG. 5B illustrates an example of excavation work in which the automatic bucket tilt control according to the above embodiment is disabled.

In FIG. 5A, a surface excavated by the bucket 6 is a slope surface. The slope surface is excavated by moving the bucket 6. Specifically, the bucket 6 is not moved just linearly along the slope surface, but is moved also in the lateral direction of the slope surface by revolving the revolving upper body 3. In such excavation work, the teeth end line 6*a* of the bucket 6 is parallel to the slope surface when the bucket 6 is at a position designated by the dotted lines. However, if the shovel is revolved, the teeth end line 6*a* of the bucket 6 becomes inclined to the slope surface (this inclination is inclination in a direction perpendicular to the page surface, and hence, not illustrated in FIG. 5A). Therefore, the angle deviation of the tilt angle of the bucket 6 to the target surface becomes large.

Thereupon, if the automatic bucket tilt control according to the embodiment is enabled, it is possible for the operator to make the teeth end line 6*a* of the bucket 6 adjusted to be parallel to the slope surface automatically, by simply operating the boom 4 and the arm 5 to move the bucket 6. Therefore, excavation is performed while having the teeth end line 6*a* of the bucket always parallel to the slope surface, which makes the entire excavation surface parallel to the slope surface.

On the other hand, to perform the same excavation work with the disabled automatic bucket tilt control according to the embodiment, the operator has to operate the boom 4 and the arm 5 to move the bucket 6 while adjusting the tilt angle of the bucket 6. However, it is difficult to determine and adjust the tilt (inclination) of the bucket 6 to the slope surface. Therefore, for example, as illustrated in FIG. 5B, the operator may execute an excavation operation by operating only the arm 5 and the boom 4, and then, without revolving the revolving upper body 3, moves the entire shovel a bit horizontally to perform a next excavation operation. Although it is possible for the operator to perform excavation without adjusting the tilt angle in this way, it is troublesome to perform the excavation work by moving the entire shovel. On the other hand, if the automatic bucket tilt control according to the embodiment is enabled, it is possible to precisely perform the excavation work of the slope surface without moving the entire shovel. Also, even if the entire shovel cannot be moved to an appropriate workplace due to an obstacle OB1 or the like (see FIG. 5A), if the automatic bucket tilt control according to the embodiment is enabled, it is possible to adjust the tilt angle of the bucket 6 automatically while revolving the revolving upper body 3, and to make the teeth end line 6*a* of the bucket 6 parallel to the target line.

As described above, by enabling the automatic bucket tilt control according to the embodiment when performing excavation work, it is always possible to make the teeth end line 6*a* of the bucket 6 parallel to a target excavation surface, and to perform the excavation work of the slope surface easily and precisely.

It should be understood that the invention is not limited to the above-described embodiment, but may be modified into various forms on the basis of the spirit of the invention. Additionally, the modifications are included in the scope of the invention.

What is claimed is:

1. A vehicle shovel, comprising:

an arm rotatably attached to a boom rotatably attached to a revolving body, said arm being rotatable relative to the boom on a plane perpendicular to a horizontal plane;

a bucket rotatably attached to the arm;

a tilt mechanism including a tilt axis that extends on the plane and is configured to rotatably support the bucket so as to rotate the bucket around the tilt axis;

a bucket tilt angle sensor configured to detect a tilt angle of the bucket in the direction; and a tilt angle controller configured to control adjusting the tilt angle, wherein the tilt angle controller adjusts the tilt angle by automatic control of the tilt mechanism so that a bucket line of the bucket becomes parallel to a target excavation surface.

2. A vehicle shovel, comprising:

an arm rotatably attached to a boom rotatably attached to a revolving body, said arm being rotatable relative to the boom on a plane perpendicular to a horizontal plane;

a bucket rotatably attached to the arm;

a tilt mechanism including a tilt axis that extends on the plane and is configured to rotatably support the bucket around the tilt axis;

a bucket tilt angle sensor configured to detect a tilt angle of the bucket in the direction; and a tilt angle controller configured to control adjusting the tilt angle, wherein the tilt angle controller adjusts the tilt angle by automatic control of the tilt mechanism so that a bucket line of the bucket becomes parallel to a target excavation surface, and wherein the automatic control of the tilt mechanism is enabled upon receiving an instruction generated by a switch action of an operator.

3. A vehicle shovel, comprising:

an arm rotatably attached to a boom rotatably attached to a revolving body, said arm being rotatable relative to the boom on a plane perpendicular to a horizontal plane;

a bucket rotatably attached to the arm;

a tilt mechanism including a tilt axis that extends on the plane and is configured to rotatably support the bucket around the tilt axis;

a bucket tilt angle sensor configured to detect a tilt angle of the bucket in the direction; and a tilt angle controller configured to control adjusting the tilt angle, wherein the tilt angle controller adjusts the tilt angle by automatic control of the tilt mechanism so that a bucket line of the bucket becomes parallel to a target excavation surface, and wherein the automatic control of the tilt mechanism is disabled upon detecting that a distance from a working part of the bucket and the target excavation surface is equal or more than a predetermined distance.

4. A vehicle shovel, comprising:

an arm rotatably attached to a boom rotatably attached to a revolving body, said arm being rotatable relative to the boom on a plane perpendicular to a horizontal plane;

a bucket rotatably attached to the arm;

a tilt mechanism including a tilt axis that extends on the plane and is configured to rotatably support the bucket around the tilt axis;

a bucket tilt angle sensor configured to detect a tilt angle of the bucket in the direction; and a tilt angle controller configured to control adjusting the tilt angle, wherein the tilt angle controller adjusts the tilt angle by automatic control of the tilt mechanism so that a bucket line of the bucket becomes parallel to a target excavation surface, and wherein the automatic control of the tilt mechanism is enabled and disabled based on a load applied on the bucket that is detected.

5. The vehicle shovel as claimed in claim 1, wherein the tilt angle controller is configured to form the bucket line defined by a line connecting between at least two points in the bucket, and compare the bucket line with a target line corresponding to the bucket line on the target excavation surface.

6. The vehicle shovel as claimed in claim 5, further comprising a display device that is configured to display the bucket line, the target line and an automatic control of the tilt mechanism start line at which the automatic control of the tilt mechanism starts.

7. The vehicle shovel as claimed in claim 1, wherein the boom includes a boom angle sensor configured to detect a rotation angle of the boom relative to the revolving body, wherein the arm includes an arm angle sensor configured to detect a rotation angle of the arm relative to the boom, wherein the bucket includes a bucket angle sensor configured to detect a rotation angle of the bucket relative to the arm, and wherein the tilt angle controller is configured to control adjusting the tilt angle based on detection signals output from the boom angle sensor, the arm angle sensor and the bucket angle sensor.

8. The vehicle shovel as claimed in claim 7, wherein the tilt angle controller is configured to control adjusting the tilt angle further based on a detection signal output from a body inclination sensor that is attached to the revolving body and detects inclination angles in a back-and-forth direction and a right-and-left direction of the revolving body.

9. The vehicle shovel as claimed in claim 1, wherein the tilt angle controller is configured to excavate the slope surface by rotating the revolving body and moving the bucket in a lateral direction of a slope surface.

10. The vehicle shovel as claimed in claim 1, wherein the tilt angle controller is configured to adjust the bucket line of the bucket to the target excavation surface.

11. The vehicle shovel as claimed in claim 7, wherein the vehicle shovel further comprises a display device, wherein the display device is configured to display a distance between the bucket and the target excavation surface calculated based on the rotation angle of the boom detected by the boom angle sensor, the rotation angle of the arm detected by the arm angle sensor, the rotation angle of the bucket detected by the bucket angle sensor and the tilt angle of the bucket detected by the bucket tilt angle sensor.

12. The vehicle shovel as claimed in claim 1, wherein the tilt angle controller is configured to set an automatic control of the tilt mechanism start line at which the automatic control of the tilt mechanism starts to be parallel to the target excavation surface.

13. The vehicle shovel as claimed in claim 1, wherein the automatic control of the tilt mechanism is switchable between ON and OFF.

14. The vehicle shovel as claimed in claim 13, wherein the vehicle shovel further comprises an operation unit that includes a lever that is configured to operate at least one of the vehicle shovel or the arm, said lever including switches to switch the automatic control of the tilt mechanism between ON and OFF.

15. The vehicle shovel as claimed in claim 13, wherein the switches are configured to switch the automatic control of the tilt mechanism between ON and OFF based on load imposed on the bucket.

16. The vehicle shovel as claimed in claim 13, wherein the switches are configured to switch the automatic control of the tilt mechanism between ON and OFF based on a distance from the bucket and the target excavation surface.

17. The vehicle shovel as claimed in claim 13, wherein the tilt angle controller adjusts the tilt angle by the automatic control of the tilt mechanism so that the bucket line of the bucket becomes parallel to a target excavation surface without operating the lever while the automatic bucket tilt control switch is ON upon determining that a condition is met, and the bucket is operated according to an operation of the lever without the automatic control of the tilt mechanism while the automatic bucket tilt control switch is OFF regardless meeting the condition.

18. The vehicle shovel as claimed in claim 1, wherein the bucket line of the bucket is defined as a line connecting between both ends of the cutting edge in the bucket.

19. The vehicle shovel as claimed in claim 1, wherein the tilt angle controller adjusts the tilt angle by the automatic control of the tilt mechanism so that the bucket line of the bucket becomes parallel to a target excavation surface that is inclined relative to the revolving body while the automatic bucket tilt control switch is ON when the boom or the arm are moved toward the target excavation surface.

* * * * *